US011825929B2

(12) United States Patent
Evans et al.

(10) Patent No.: US 11,825,929 B2
(45) Date of Patent: Nov. 28, 2023

(54) HAIR TIE

(71) Applicants: Daniel Evans, North Hills, CA (US); Joey Evans, North Hills, CA (US)

(72) Inventors: Daniel Evans, North Hills, CA (US); Joey Evans, North Hills, CA (US)

( * ) Notice: Subject to any disclaimer, the term of this patent is extended or adjusted under 35 U.S.C. 154(b) by 139 days.

(21) Appl. No.: 17/165,748

(22) Filed: Feb. 2, 2021

(65) Prior Publication Data

US 2021/0244154 A1 Aug. 12, 2021

Related U.S. Application Data

(60) Provisional application No. 62/975,343, filed on Feb. 12, 2020.

(51) Int. Cl.
*A45D 8/34* (2006.01)

(52) U.S. Cl.
CPC ..... *A45D 8/34* (2013.01)

(58) Field of Classification Search
CPC ... A45D 8/36; A45D 8/34; A45D 8/00; Y10T 24/3918; F16B 11/0044; F16B 11/48
See application file for complete search history.

(56) References Cited

U.S. PATENT DOCUMENTS 5,289,834 A 3/1994 Lawrence
5,778,904 A 7/1998 Elsner
6,182,672 B1 2/2001 Abasta-Douglas et al.
6,213,130 B1 4/2001 Alessandrino
6,267,120 B1 * 7/2001 Serignat ..... A45D 8/34 132/273
6,311,699 B1 11/2001 Horman
6,397,857 B2 6/2002 Neary
6,601,589 B2 * 8/2003 Ericks ..... A45D 8/34 132/273
7,174,901 B2 2/2007 Haar et al.
2005/0109361 A1 5/2005 Klug
2006/0096067 A1 * 5/2006 Fontaine ..... F16G 11/103 24/130
2010/0030215 A1 * 2/2010 Dell'Oca ..... A61B 17/842 606/74
2011/0011763 A1 * 1/2011 Doyle ..... A45D 8/26 132/275
2015/0027479 A1 * 1/2015 Lei ..... A45D 8/34 132/273

* cited by examiner

*Primary Examiner* — Cris L. Rodriguez
*Assistant Examiner* — Sydney J Pulvidente
(74) *Attorney, Agent, or Firm* — Nolan Heimann LLP; Adam Diament

(57) ABSTRACT

An adjustable hair tie where the band or cord can easily be adjusted to a variety of thicknesses of hair. The hair tie includes an elongated stretchable cord, a cleat, a plurality of apertures positioned along the length of the cleat, a first set of apertures forming a first passageway, and a second set of apertures forming a second passageway. The first end of the cord is securely attached at one end of the cleat, and the second end of the cord traverses through the second passageway. The free end of the cord is pulled under the application of force to crimp the cord and the cord loops around the cleat such that when the force is removed, the cord contracts, causing it to constrict, thereby securing the cord within the cleat and providing an easily adjustable sized cord loop to retain hair.

9 Claims, 6 Drawing Sheets

HAIR TIE

CROSS-REFERENCE TO RELATED APPLICATIONS

This application claims priority to and benefit of U.S. Provisional Patent Application No. 62/975,343, entitled, "Hair Tie," to Evans et al., filed on Feb. 12, 2020, the contents of which are incorporated by reference in its entirety.

FIELD OF THE INVENTION

The present subject matter generally relates to hair ties, and in the technical field of hair accessories. More particularly to an adjustable hair tie where the band or cord can easily be adjusted to a variety of thicknesses of hair.

BACKGROUND OF THE INVENTION

Hair ties (also called hair elastics, ponytail holders, or hair bands) are generally known in the art. The hair tie is an item commonly used by a person with long hair for fastening a bundle of hair, such as a ponytail, on the back of the person's head. On the market, there are many various different kinds of hair ties, such as ribbons, bobbles, scrunchies, bands, hair rings, hair binders, hair holders, and various others. The prior art has developed a variety of hair ties known in the art capable of at least partially securing a piece of hair for at least some time.

In many current types of hair ties, different hair thicknesses require rubber-band style hair ties to be twisted, and the hair has to be pulled through multiple times to find the right tightness to secure the hair in place. This is time consuming, can cause bands to break, and often is difficult to remove.

U.S. Pat. No. 6,213,130 shows a ponytail hair style applied by a user without assistance by reaching behind and performing all of the steps by feel, using a slip knot to establish the ponytail and encircle it in helical turns within ties extending from the slip knot and joined at free ends just beyond the last helical turn by the insertion of a display object on one tie in a closed loop of elastic on the other tie. A ponytail-engaging component is provided that comprises a lasso loop with a decorative slide for tightening the lasso loop around the ponytail.

U. S. Pat. Pub. No. US20050109361A1 shows a decorative hair fastener and particularly to a decorative ponytail cord device that comprises a braided double loop secured around the ponytail by an adjustable sliding bead or cord lock with loose unbraided ends embellished with beads hanging down the ponytail.

All the prior approaches don't address different thicknesses of hair and getting the right size loop to secure the ponytail and lock the ponytail holder in place. Further, prior methods are more laborious and less secure, as in pulling the ponytail through multiple loops by twisting and pulling through another loop. Other methods also pull the hair into the securing piece resulting in tangled or broken hair upon removal or rigorous use.

Therefore there still remains a need for a hair tie which can secure a piece of hair of any size type or style and that does not create any bumps, dents or creases in the piece of hair is currently needed. The hair tie disclosed herein provides such a hair tie. These and other advantages of the invention, as well as additional inventive features, will be apparent from the description of the invention provided herein.

SUMMARY OF THE INVENTION

The inventive concepts presented herein are illustrated in a number of different embodiments, each showing one or more concepts, though it should be understood that, in general, the concepts are not mutually exclusive and may be used in combination even when not so illustrated.

Accordingly, in one aspect of a hair tie comprises a cord having a first end and a second end opposite the first end, wherein the cord is elongated and stretchable. The hair tie also includes a cleat having a cleat main body, a plurality of apertures positioned along a length of the cleat, a first set of apertures forming a first passageway, and a second set of apertures forming a second passageway. The first passageway is positioned at a lower part of the cleat main body and the second passageway is positioned at an upper part of the cleat main body. The the first end of the cord is securely attached at one end of the first passageway, and the cord traverses through the first passageway and the second passageway to form a cord loop. The second end of the cord has a free end capable of being pulled under application of an expanding force to stretch the cord, into a state whereby when the expanding force is removed, the cord contracts in the length into an unstretched state or a relaxed state, thereby securing the cord within the cleat, and securing hair within the cord loop.

In some embodiment, the hair tie includes an elongated stretchable cord having a first end and a second end opposite the first end, and a cleat having a main body, a front facing opening having ridges and a plurality of apertures positioned along the length of the cleat, a first set of apertures forming a first passageway and a second set of apertures forming a second passageway, the first passageway is at the lower part of the cleat main body and the second passageway is positioned is at the upper part of the cleat main body. The apertures form the entry and exit locations of the passageways. The first end of the cord is securely attached at one end over the first passageway of the cleat, and the second end of the cord traverses the second passageway and exits at the front facing opening of the cleat. The second end of the cord, which has a free end pulled under the application of force, crimp within the cleat and loops around the cleat main body such that when the cord is pulled through the front facing opening and moves the cord with a 90° turn on the left or right side of the cleat main body. To release the hair, the cord is moved back to the front facing opening and the cord is pulled out through to loosen the loop.

In some embodiments the hair tie includes an elongated stretchable cord having a first end and a second end opposite the first end, and a cleat having a main body, at least two front facing openings including ridges, a first front facing opening and a second front facing opening, and a plurality of apertures positioned along the length of the cleat, a first set of apertures forming a first passageway and a second set of apertures forming a second passageway, the first passageway is at the lower part of the cleat main body and the second passageway is positioned is at the upper part of the cleat main body. The first end of the cord is securely attached at one end over the first passageway of the cleat, and the second end of the cord traverses the second passageway and exits at the front facing opening of the cleat. The second end of the cord, which is a free end pulled under the application of force to crimp, and also loops around the cleat main body such that when the cord is pulled through the first front facing opening which squeezes (i.e. compresses and wedges) the cord to secure it in place and further moves the cord through the second front facing opening for a 90° turn on the left or right side of the cleat main body.

To further clarify advantages and features of the present invention, a more particular description of the invention will be rendered by reference to specific embodiments thereof, which is illustrated in the appended figures. It is appreciated that these figures depict only typical embodiments of the invention and are therefore not to be considered limiting of its scope.

BRIEF DESCRIPTION OF THE DRAWINGS

The above contents of the present invention will become more readily apparent to those ordinarily skilled in the art after reviewing the following detailed description and accompanying drawings, in which.

Figure 1D:
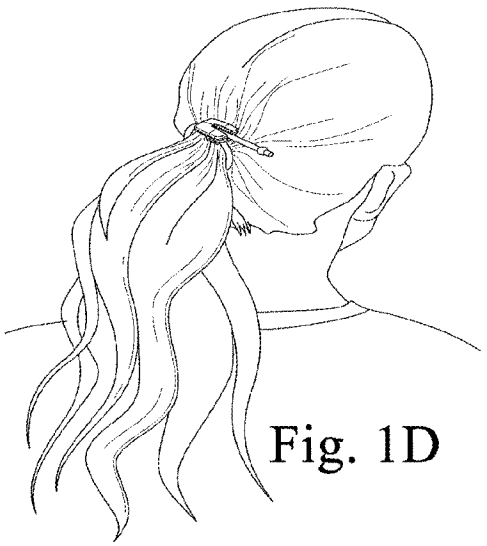
FIG. 1D is an environmental view of the hair tie of FIG. 1A around a pony tail.
Figure 1C:
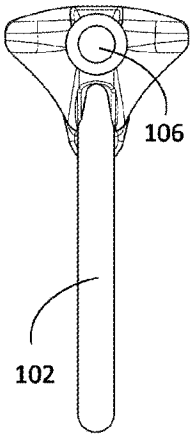
FIG. 1C is a front view illustrating the their tie of FIG. 1A.
Figure 1B:
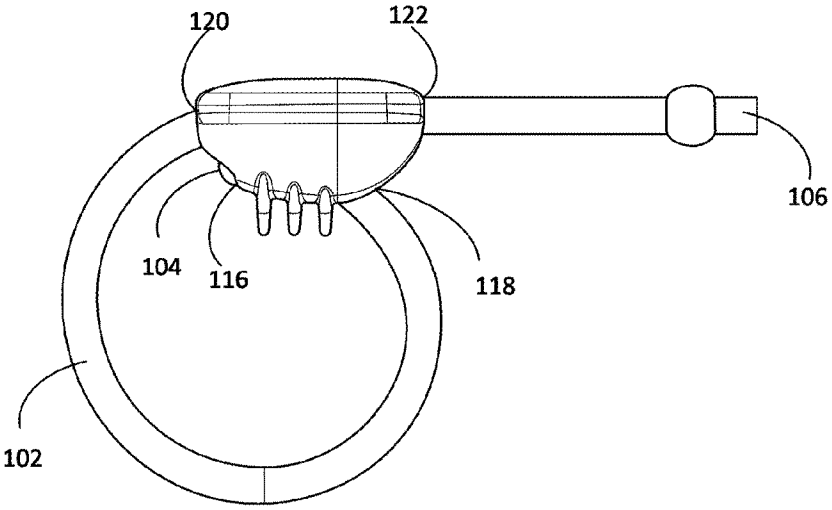
FIG. 1B is a side view illustrating the hair tie of FIG. 1A.
Figure 1A:
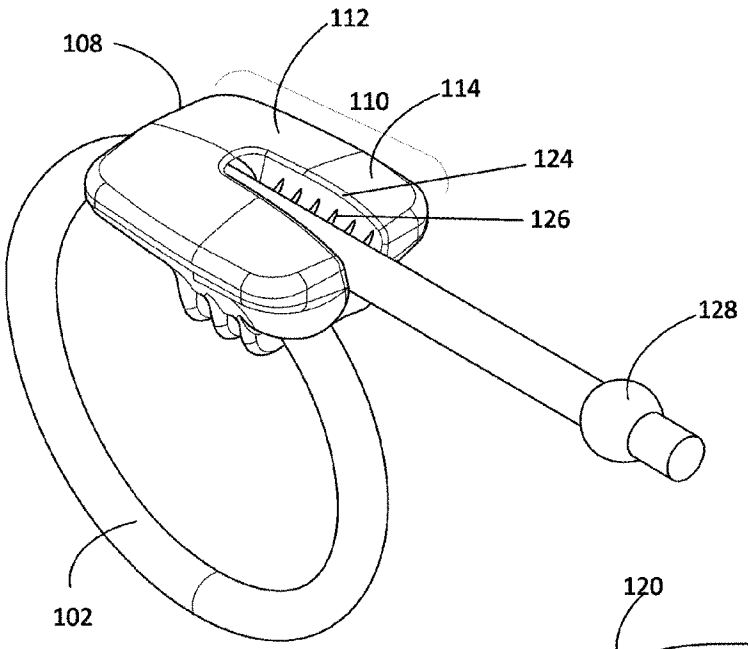
FIG. 1A is a perspective view illustrating a hair tie according to one embodiment of the invention.

Further, skilled artisans will appreciate that elements in the figures are illustrated for simplicity and may not have necessarily been drawn to scale.

Furthermore, in terms of the construction of the device, one or more components of the device may have been represented in the figures by conventional symbols, and the figures may show only those specific details that are pertinent to understanding the embodiments of the present invention so as not to obscure the figures with details that will be readily apparent to those of ordinary skill in the art having benefit of the description herein.

DETAILED DESCRIPTION OF THE DRAWINGS

The invention now will be described more fully hereinafter with reference to the accompanying drawings, in which embodiments of the invention are shown. This invention may however be embodied in many different forms and should not be construed as limited to the embodiments set forth herein. Rather, these embodiments are provided so that this disclosure will be thorough and complete, and will fully convey the scope of the invention to those skilled in the art.

It will be understood that when an element is referred to as being "on" another element, it can be directly on the other element or intervening elements may be present therebetween. As used herein, the term "and/or" includes any and all combinations of one or more of the associated listed items.

It will be understood that, although the terms first, second, third etc. may be used herein to describe various elements, components, regions, layers, and/or sections, these elements, components, regions, layers, and/or sections should not be limited by these terms. These terms are only used to distinguish one element, component, region, layer, and/or section from another element, component, region, layer, and/or section.

It will be understood that the elements, components, regions, layers and sections depicted in the figures are not necessarily drawn to scale.

The terminology used herein is for the purpose of describing particular embodiments only, and is not intended to be limiting of the invention. As used herein, the singular forms "a," "an," and "the," are intended to include the plural forms as well, unless the context clearly indicates otherwise. It will be further understood that the terms "comprises" and/or "comprising," or "includes" and/or "including," when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom," "upper" or "top," "left" or "right," "above" or "below," "front" or "rear," may be used herein to describe one element's relationship to another element as illustrated in the Figures. It will be understood that relative terms are intended to encompass different orientations of the device in addition to the orientation depicted in the Figures.

Ranges: throughout this disclosure, various aspects of the invention can be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 2.7, 3, 4, 5, 5.3, and 6. This applies regardless of the breadth of the range.

Unless otherwise defined, all terms used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments of the present invention are described herein with reference to idealized embodiments of the present invention. As such, variations from the shapes of the illustrations as a result, for example, of manufacturing techniques and/or tolerances, are to be expected. The numbers, ratios, percentages, and other values may include those that are ±5%, ±10%, ±25%, ±50%, ±75%, ±100%, ±200%, ±500%, or other ranges that do not detract from the spirit of the invention. The terms about, approximately, or substantially may include values known to those having ordinary skill in the art. If not known in the art, these terms may be considered to be in the range of up to ±5%, ±10%, or other value higher than these ranges commonly accepted by those having ordinary skill in the art for the variable disclosed. Thus, embodiments of the present invention should not be construed as limited to the particular shapes of regions illustrated herein but are to include deviations in shapes that result, for example, from manufacturing. The invention illustratively disclosed herein suitably may be practiced in the absence of any elements that are not specifically disclosed herein.

All references to U.S. Patents, U.S. Patent Applications, Foreign Patent Documents, and Non-Patent Literature in the Specification are hereby incorporated by reference in their entireties.

FIG. 1 schematically illustrates an embodiment of a hair tie according to the present invention. The hair tie includes an elongated stretchable cord 102, a cleat 108, and engaging member 128, as exemplified in FIG. 1(A-D). The elongated stretchable cord 102 having a first end 104 and a second end 106 opposite the first end 104. The cord 102 may be made from a material that is elastic in at least the circumferential (radial) direction, but the cord may be axially elastic as well. For example, the cord may be made from one or more of an elastic fabric, such as a stretchable nylon or spandex, and may be constructed by, for example, the sewing together of various fabric patterns, or by appropriate knitting or weaving. It may also be possible to construct the cord body from a molded or otherwise formed stretchable foam material. In any event, at least the exposed surface is made from or covered or coated with a low coefficient of friction material that facilitates the deliberate removal of hair from the device.

The cleat 108 comprises a solid piece of material, and the shape of the cleat includes cylindrical, rectangular or a combination or variance of that nature which fit on a ponytail. In an example the cleat main body dimension of approximately 1" long by ½" wide by ½" deep. The cleat 108 having a main body 110 and a plurality of apertures (116, 118, 120 and 122) positioned along the length of the cleat. A first set of apertures (116, 118) forming a first passageway and a second set of apertures (120, 122) forming a second passageway. In an example embodiment. the first passageway is at the lower part of the cleat main body and the second passageway is positioned is at the upper part of the cleat main body. The first end 104 of the cord is securely attached at one end over the first passageway of the cleat i.e. at 116, and the second end 106 of the cord traverses the second passageway and exists near the middle of the main body of the cleat 108.

In an example embodiment the first passageway has a dimension sized to permit passage through the apertures and the second passageway has a dimension sized to prohibit or at least substantially inhibit passage through the apertures. In one example, the apertures and passageways may have a dimension approximately equal in size to the cross section of the cord. In an example embodiment, the apertures along the length of the cleat are of a conical shape from one end toward mid-range of the cleat, the conical apertures are having larger opening on the outer end and the smaller opening in the mid-range area. Further, the upper part of the cleat main body 110 includes two regions, a first region 112 and a second region 114. In an example embodiment, the first region is enclosed by the cleat main body and the second region includes an open wedge-shaped region 124 having a plurality of ridges 126. The open wedge-shaped region may have a wide portion and a narrow portion, the narrow portion sized and shaped to secure the cord by crimping the cord within the narrow portion to wedge and secure the cord in the cleat.

The dimension discussed above may be a cross-sectional diameter of the cord. In some embodiments, the cross-sectional diameter of the cord is greater than at least one of the second set of apertures when the cord is in the relaxed state or the unstretched state and the cross-section diameter of the cord is smaller than at least one of the second set of apertures when the cord is in the stretched state, thereby allowing the cord to more freely pass through the second passageways when the cord is in the stretched state relative to when the cord is in the unstretched state.

The first passageway is characterized as having a first passageway dimension sized to permit the cord to pass through the first passageway, and the second passageway is characterized as having a second passageway dimension sized to substantially inhibit passage of the cord through at least one of the second set of apertures.

In this embodiment, the second end of the cord which is a free end pulled under the application of force to crimp and loops around the cleat main body such that when the expanding force is removed the cord contracts around the cord body causing it to constrict and thereby securing the cord within the cleat. In particular, the cord is pulled through the second passageway to adjust it and pops the cord down or horizontally into the second set of apertures for tightening the cord, and to loosening it, the cord up out of the second passageway which allows it to easily slide and adjust. The wedge-shaped region of the cleat having a narrow end near the middle and wider end at the later part of the region, which allows the cord to freely move within the wider parts of the wedge space, and to secure the cord, the cord is pulled such that part of the cord wedges within the narrow part near the middle of the region. In an example embodiment, the diameter of the aperture at the exit point is smaller than the diameter of the cross section of the cord, when the cord is in its relaxed or unstretched state, and when the cord is stretched, the cross-sectional diameter decreases, which allows the cord to more freely pass through the aperture and passageway.

As can been in all of the figures, the securing of the cord at one end and traversing through the first passageway and the second passageway forms a cord loop. It is through this cord loop that hair can be passed through, thereby forming a ponytail.

Figure 2A:
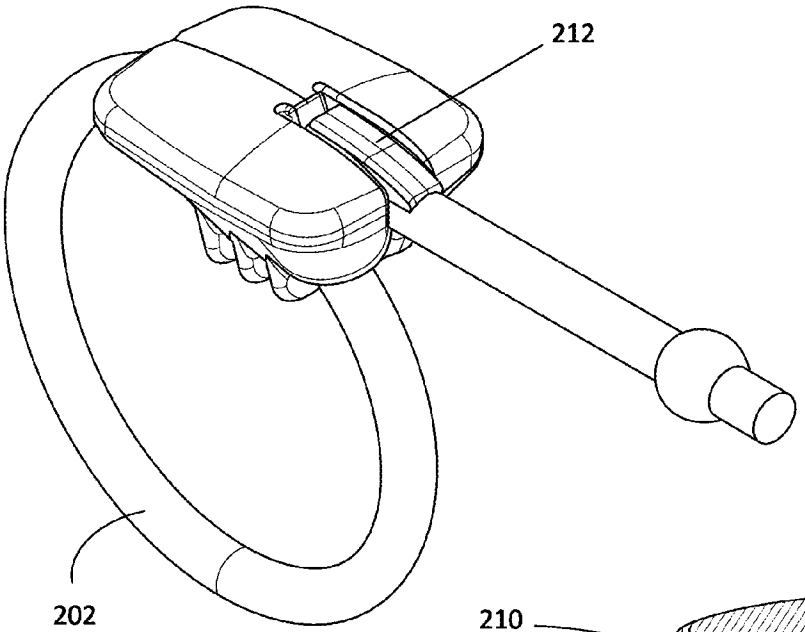
FIG. 2A is a perspective view of an embodiment of a hair tie having a tab for securing the cord to the main body.
Figure 2B:
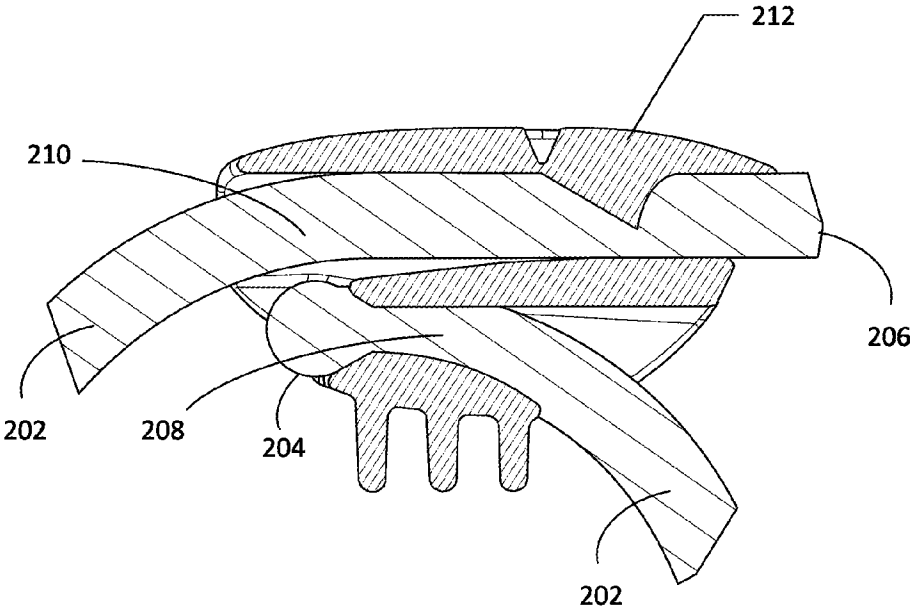
FIG. 2B is a cross-sectional view of the hair tie of FIG. 2A.
Figure 2C:
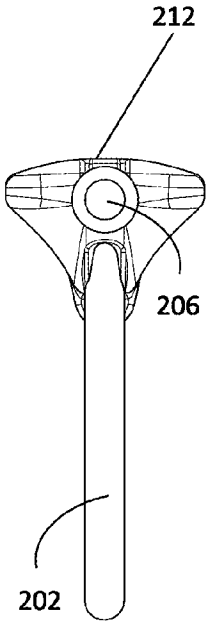
FIG. 2C is a front view of the hair tie of FIG. 2A.

FIG. 2(A-C) shows a schematic diagram illustrating the use of a tab connected to the cleat in a hair tie of the invention. The hair tie includes an elongated stretchable cord 202 having a first end 204 and a second end 206 opposite the first end 204. The cleat, has a first passageway 208 and a second passageway 210. In this embodiments a tab 212 is provided on the cleat. In order to operate, user has to presses down in its natural state, and if user want to loosen the loop one would lift up on the tab 212. In an embodiment, the cleat may also have tapered groove or passage as explained in the embodiment of FIG. 1.

Figure 3C:
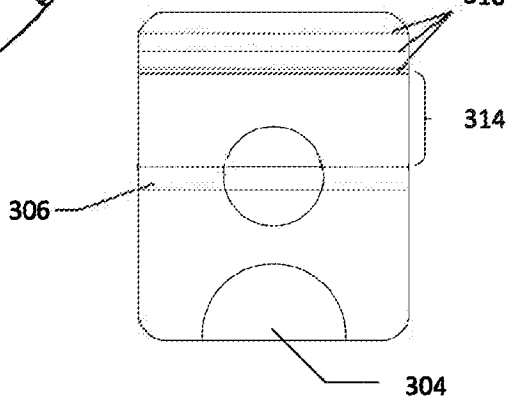
FIG. 3C is a front view of the hair tie of FIG. 3A.
Figure 3A:
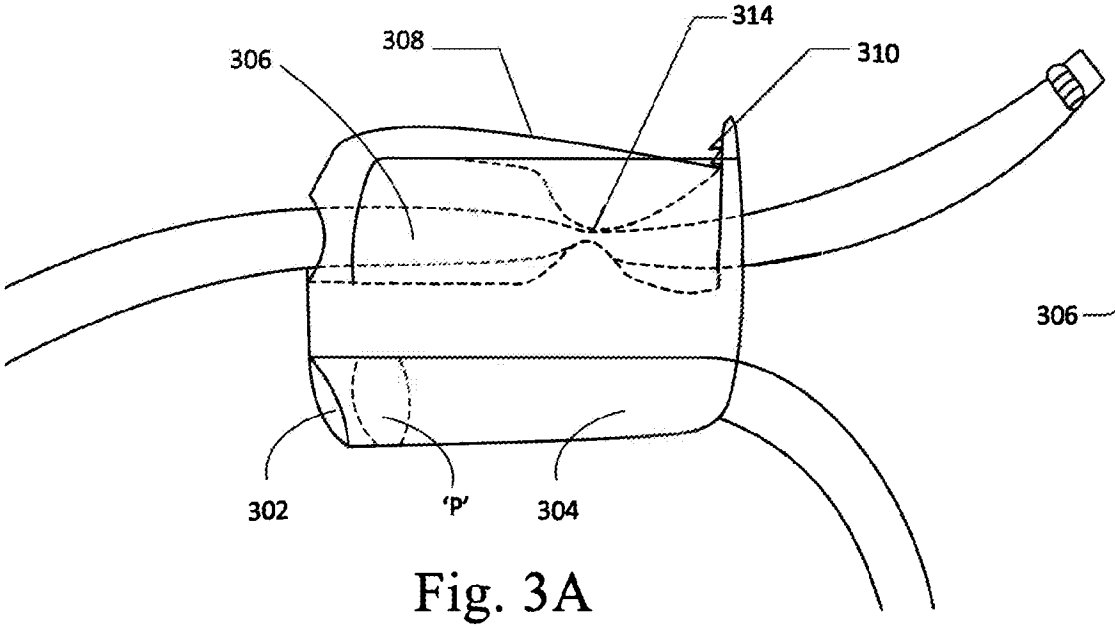
FIG. 3A is a side view of an embodiment of a hair tie having locking teeth tab, showing the internal construction.
Figure 3B:
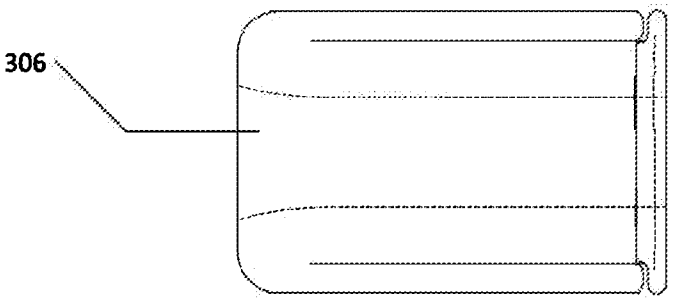
FIG. 3B is a top view of the hair tie of FIG. 3A.

FIG. 3(A-C) shows a schematic diagram illustrating internal construction a hair tie as described in FIG. 2. FIG. 3A shows the internal construction, where the cord first end 302 which is crimped "P" at the first passageway 304 and enters in the second passageway 306. In the second passageway 306, using the pinching tab 308, one can pinch in order to secure the cord in order to secure the cord and further at the end of the second passageway provided with the locking teeth tab 310. The second passageway may be or may include tapered groove which allows the cord to get wedged inside. FIG. 3B shows the partial top view of the hair tie where at the end of the second passageway is tab having the locking teeth tab 310. FIG. 3C shows the front view of the hair tie showing the pinched (or crimped) region 314, where the pinching tab 308 is pressed against the locking teeth tab 310.

Figure 4A:
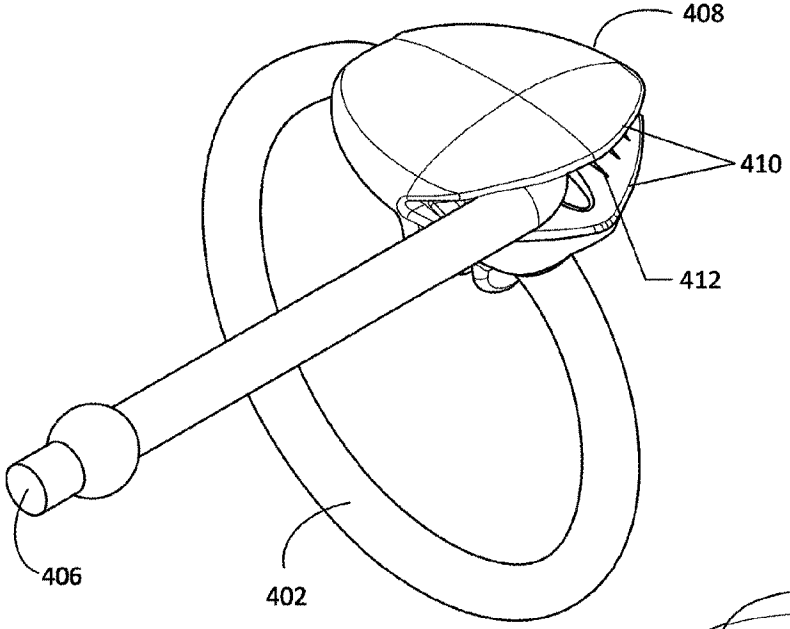
FIG. 4A is a perspective view illustrating a side cleat embodiment of the hair tie.
Figure 4B:
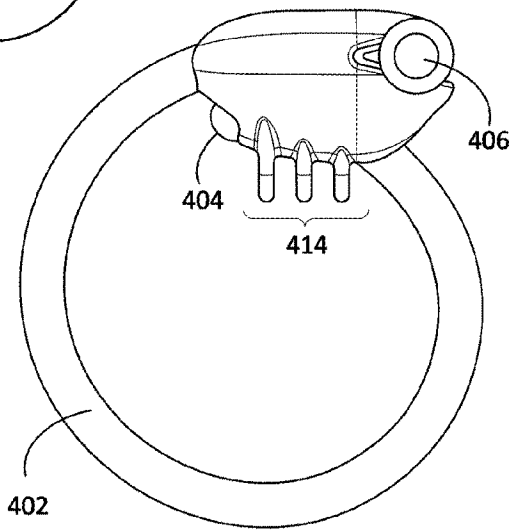
FIG. 4B is a side view illustrating the side cleat embodiment of the hair tie of FIG. 4A.
Figure 4C:
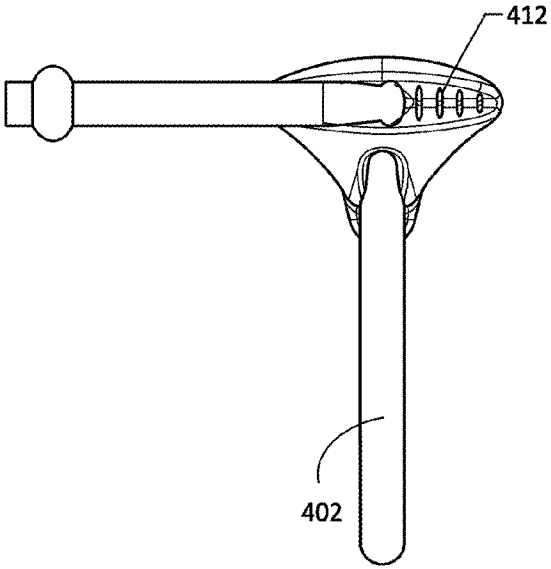
FIG. 4C is a front view illustrating the side cleat embodiment of the hair tie of FIG. 4A.

FIG. 4(A-C) shows a schematic diagram illustrating side cleat of a hair tie according to one embodiment of the invention. In this embodiment, the hair tie includes an elongated stretchable cord 402 having a first end 404 and a second end 406 opposite the first end 404. A cleat 408 having a front facing opening 410 which is open wedged-shaped region having ridges 412 and a plurality of apertures positioned along the length of the cleat, a first set of apertures forming a first passageway and a second set of apertures forming a second passageway. The apertures forming the passageway are of the same construction as described in FIG. 1. The first passageway is at the lower part of the cleat main body and the second passageway is positioned is at the upper part of the cleat main body. The first end of the cord is securely attached at one end over the first passageway of the cleat, and the second end of the cord traverses the second passageway and exists at the front facing opening 410 of the cleat. Further, the cleat has a plurality of fins 414 at the bottom of the cleat for retaining the hair, as the hair will divide between the fins, thereby preventing the hair tie from accidental movement. During operation, the second end of the cord which is a free end pulled under the application of force to crimp, and loops around the cleat main body such that when the cord is pulled through the front facing opening and moves the cord with a 90° turn on the left or right side of the cleat main body, and to release the hair, the cord is moved back to the front facing opening and the cord is pulled out through the second passageway to loosen (i.e. expand) the loop to release the hair.

Figure 5B:
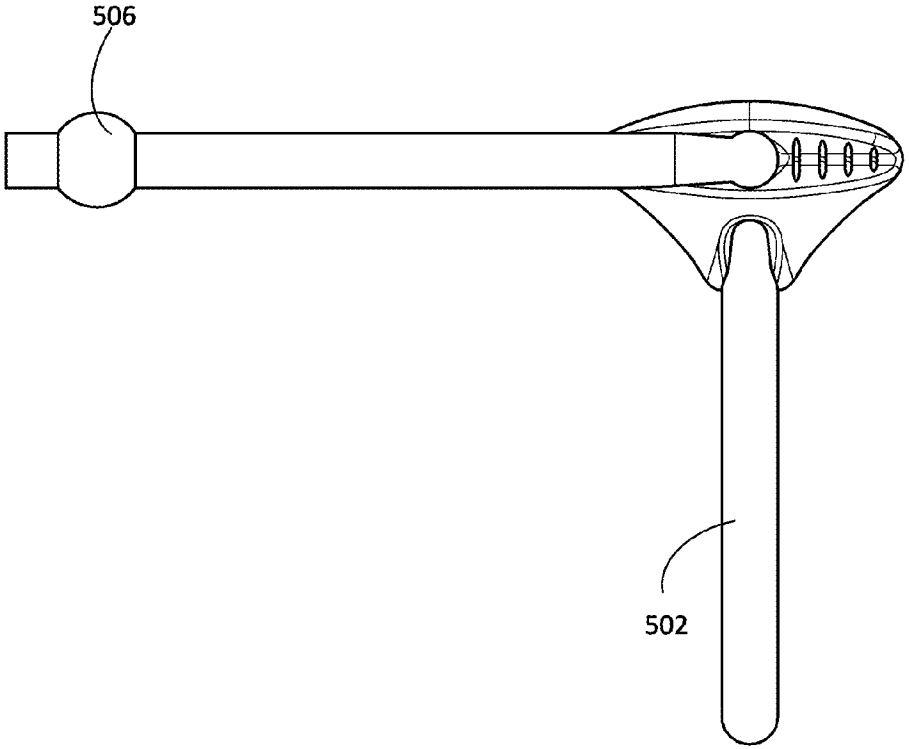
FIG. 5B is a front view illustrating the side cleat of a hair tie of FIG. 5A.
Figure 5A:
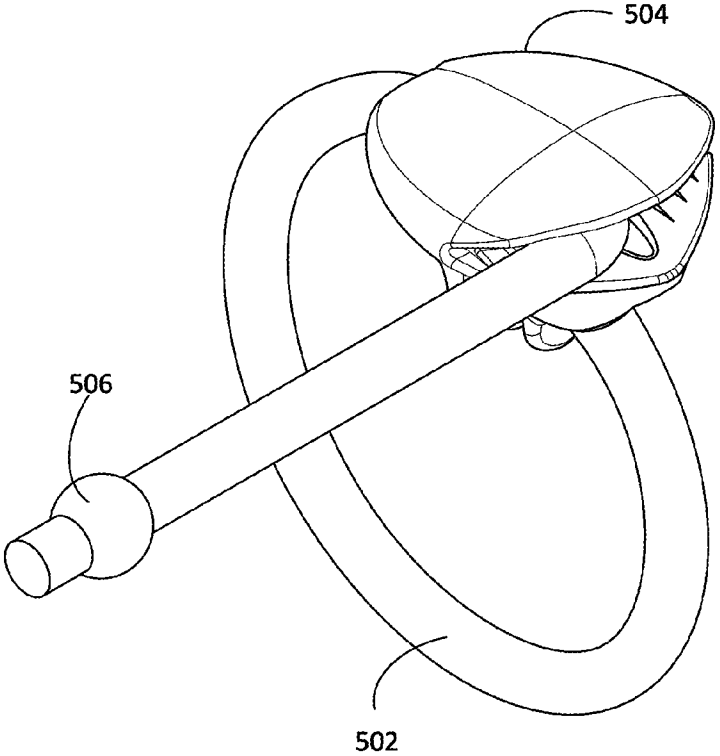
FIG. 5A is a perspective illustrating a side cleat of a hair tie according to another embodiment of the invention of FIG. 4A.

FIG. 5(A-B) shows another embodiment of the side cleat of a hair tie as described in FIG. 4, where the cleat 504 is without the fins. Further, the hair tie which has cord 502 having two ends i.e. first end and the second end. The second end has the engaging member 506 which used to secure the tying. The engaging member 506 may be a piece of metal, plastic or any other material, curved or bent back at an angle, for catching hold of or hanging things on. The engaging member 506 may be present in any of the embodiments described (such as shown as an engaging member 128 in FIGS. 1A-D) and prevents full withdrawal of the cord out of the second passageway due to the size of the engaging member being larger than the second passageway.

Figure 6B:
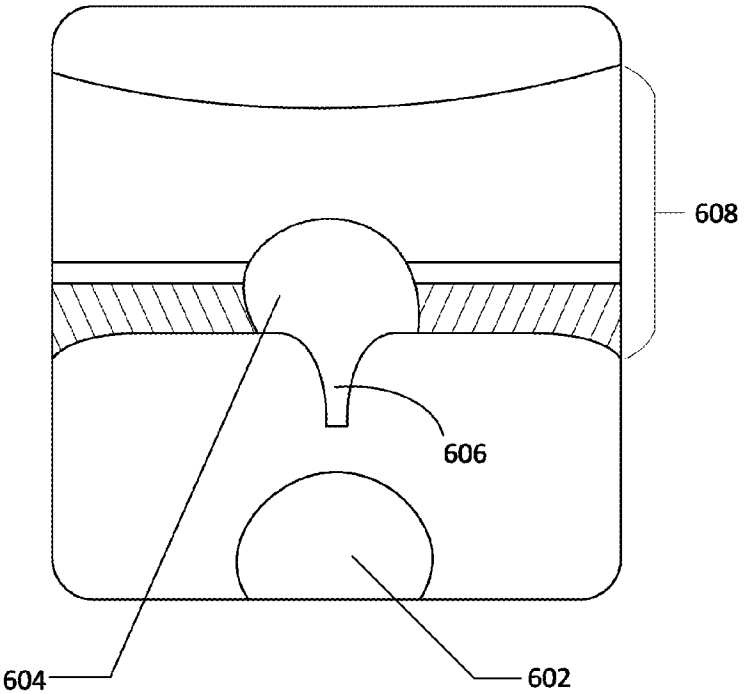
FIG. 6A is cross-sectional view illustrating a side and vertical diagram vertical cleat in combination for a hair tie according to one embodiment of the invention; and, FIG. 6B is cross-sectional view illustrating a side and vertical diagram vertical cleat in combination for a hair tie according to one embodiment of the invention.
Figure 6A:
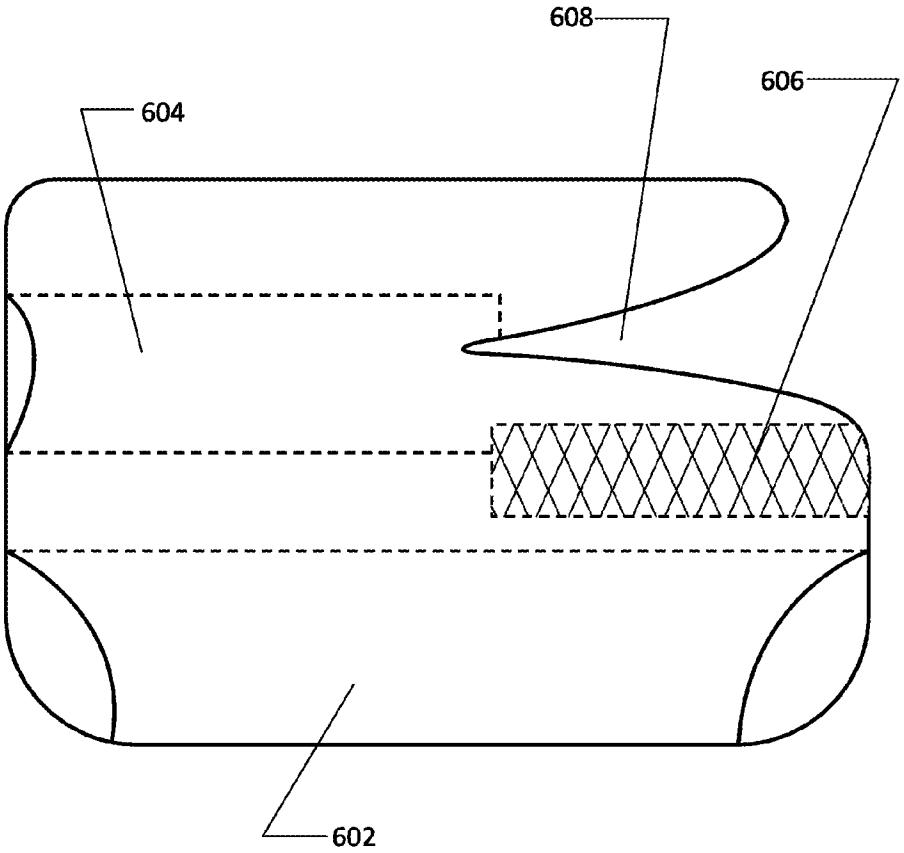

FIG. 6(A-B) shows a schematic diagram illustrating side and vertical cleat of a hair tie according to one embodiment of the invention. In this embodiment of the hair tie, the cleat has two front facing opening having ridges, a first front facing opening 606 and a second front facing opening 608. When the second end of the cord, which has a free end, is pulled under the application of force to crimp the cord, and also loops around the cleat main body such that when the cord is pulled through the first front facing opening 606, which wedges the cord to secure it in place, and further moves the cord through the second front facing opening for a 90° turn (or rotation) on the left or right side of the cleat main body. The cord is secured within the first passageway 602. The first front facing opening 606 is in the second passageway 604 for vertical securing of the cord, and the second front facing opening 608 is in the cleat main body for horizontal securing of the cord. In an example, first pulling into the vertical cleat (wrapping an excess cord around ponytail) and then through the side of the cleat for a final securing. Although the degrees of turning (either on the left side of the cleat or right side of the cleat) are listed as 90°, this is just an exemplary embodiment and the degree of rotation of the cord may accomplished with a rotation of at least 70°, or less, or between 70° to 110°, 60° to 120°, 50° to 130°, or other range outside of these values that accomplishes wedging within the first front facing opening 606, without detracting from the spirit of the invention.

While the exemplary embodiments have been described in some detail, by way of example and for clarity of understanding, those of skill in the art will recognize that a variety of modification, adaptations, and changes may be employed. Hence, the scope of the present invention should be limited solely by the appending claims.

In the foregoing specification, the invention is described with reference to specific embodiments thereof, but those skilled in the art will recognize that the invention is not limited thereto. Various features, embodiments and aspects of the above-described invention can be used individually or jointly. Further, the invention can be utilized in any number of environments and applications beyond those described herein without departing from the broader spirit and scope of the specification. The specification and drawings are, accordingly, to be regarded as illustrative rather than restrictive. Any of the features describe may be placed individually or in combination in any of the other embodiments described, even if not explicitly stated.

What is claimed is:

1. A hair tie, comprising:

a) a cord having a first end and a second end opposite the first end, wherein the cord is elongated and stretchable; and, b) a cleat having:

i) a cleat main body, ii) a plurality of apertures positioned along a length of the cleat, including a first set of apertures forming a first passageway, and a second set of apertures forming a second passageway, iii) a plurality of fins at a bottom of the cleat for retaining hair, whereby the plurality of fins are configured to divide hair of a user, thereby preventing the hair tie from accidental movement, c) a tab connected to the cleat main body, wherein after the cord is pulled through the second passageway, the tab is pressed to secure the cord, and wherein to loosen the cord, the tab is lifted up, thereby allowing the cord to slide within the second passageway, thereby allowing a user to adjust a size of the cord loop;

wherein the first passageway is positioned at a lower part of the cleat main body and the second passageway is positioned at an upper part of the cleat main body, wherein the first end of the cord is securely attached at one end of the first passageway, and the cord traverses through the first passageway and the second passageway to form a cord loop, wherein the second end of the cord has a free end, and wherein the second end of the cord is capable of being pulled under application of an expanding force to stretch the cord into a stretched state; and, whereby when the expanding force is removed, the cord contracts in the length into an unstretched state or a relaxed state, thereby securing the cord within the cleat, and securing hair within the cord loop.

2. The hair tie of claim 1, wherein the upper part of the cleat main body includes two regions, a first region and a second region, wherein the first region is enclosed by the cleat main body and the second region includes an open wedge-shaped region having a plurality of ridges.

3. The hair tie of claim 1, wherein the second passageway is sized to have a diameter approximately equal to a cross-sectional diameter of the cord.

4. The hair tie of claim 1, wherein the cleat further comprises an open-wedged shaped region for securing the cord within the cleat.

5. The hair tie of claim 4, wherein the open wedged-shaped region has a narrow portion and a wide portion, and the open wedged-shaped region is sized and shaped to allow the cord to freely move within the wide portion, and the narrow portion is sized and shaped to secure the cord by crimping the cord within the narrow portion to secure the cord in the cleat.

6. The hair tie of claim 1, wherein the cleat main body comprises a solid piece of material of approximately 1" long by approximately ½" wide by approximately ½" deep.

7. The hair tie of claim 1, wherein the cleat further comprises a plurality of fins positioned at a bottom of the cleat for retaining hair.

8. A hair tie, comprising:

a) a cord having a first end and a second end opposite the first end, wherein the cord is elongated and stretchable; and, b) a cleat having:

i) a cleat main body, ii) a plurality of apertures positioned along a length of the cleat, including a first set of apertures forming a first passageway, and a second set of apertures forming a second passageway, iii) a plurality of fins at a bottom of the cleat for retaining hair, whereby the plurality of fins are configured to divide hair of a user, thereby preventing the hair tie from accidental movement, wherein the first passageway is positioned at a lower part of the cleat main body and the second passageway is positioned at an upper part of the cleat main body, wherein the first end of the cord is securely attached at one end of the first passageway, and the cord traverses through the first passageway and the second passageway to form a cord loop, wherein the second end of the cord has a free end, and wherein the second end of the cord is capable of being pulled under application of an expanding force to stretch the cord into a stretched state; and, whereby when the expanding force is removed, the cord contracts in the length into an unstretched state or a relaxed state, thereby securing the cord within the cleat, and securing hair within the cord loop;

wherein the second passageway is of a conical shape.

9. A hair tie, comprising:

a) a cord having a first end and a second end opposite the first end, wherein the cord is elongated and stretchable; and, b) a cleat having:

i) a cleat main body, ii) a plurality of apertures positioned along a length of the cleat, including a first set of apertures forming a first passageway, and a second set of apertures forming a second passageway, iii) a plurality of fins at a bottom of the cleat for retaining hair, whereby the plurality of fins are configured to divide hair of a user, thereby preventing the hair tie from accidental movement, wherein the first passageway is positioned at a lower part of the cleat main body and the second passageway is positioned at an upper part of the cleat main body, wherein the first end of the cord is securely attached at one end of the first passageway, and the cord traverses through the first passageway and the second passageway to form a cord loop, wherein the second end of the cord has a free end, and wherein the second end of the cord is capable of being pulled under application of an expanding force to stretch the cord into a stretched state; and, whereby when the expanding force is removed, the cord contracts in the length into an unstretched state or a relaxed state, thereby securing the cord within the cleat, and securing hair within the cord loop;

wherein the first passageway has a first passageway dimension sized to permit the cord to pass through the first passageway, and the second passageway has a second passageway dimension sized to substantially inhibit passage of the cord through at least one of the second set of apertures;

wherein the cord has a cross-sectional diameter, wherein the cross-sectional diameter of the cord is greater than at least one of the second set of apertures when the cord is in the relaxed state or the unstretched state; and, wherein the cross-sectional diameter of the cord is smaller than at least one of the second set of apertures when the cord is in the stretched state, thereby allowing the cord to more freely pass through the second passageway when the cord is in the stretched state relative to when the cord is in the unstretched state.

* * * * *